US007939787B2

(12) United States Patent
Ripley

(10) Patent No.: US 7,939,787 B2
(45) Date of Patent: May 10, 2011

(54) APPARATUS WITH MODERATING MATERIAL FOR MICROWAVE HEAT TREATMENT OF MANUFACTURED COMPONENTS

(75) Inventor: Edward B. Ripley, Knoxville, TN (US)

(73) Assignee: Babcock & Wilcox Technical Services Y-12, LLC, Oak Ridge, TN (US)

( * ) Notice: Subject to any disclaimer, the term of this patent is extended or adjusted under 35 U.S.C. 154(b) by 465 days.

(21) Appl. No.: 12/038,172

(22) Filed: Feb. 27, 2008

(65) Prior Publication Data

US 2008/0142511 A1 Jun. 19, 2008

Related U.S. Application Data

(62) Division of application No. 11/567,025, filed on Dec. 5, 2006, now Pat. No. 7,358,469, which is a division of application No. 11/269,236, filed on Nov. 8, 2005, now Pat. No. 7,161,126.

(60) Provisional application No. 60/626,715, filed on Nov. 10, 2004.

(51) Int. Cl.
*H05B 6/60* (2006.01)

(52) U.S. Cl. ..... 219/775; 219/679; 219/762; 219/770; 219/759

(58) Field of Classification Search ..... 219/775, 219/701, 710, 759, 770, 679, 762; 600/407, 600/430

See application file for complete search history.

(56) References Cited

U.S. PATENT DOCUMENTS

| | | | | |
|---|---|---|---|---|
| 4,104,804 | A | 8/1978 | Sargeant | |
| 4,176,268 | A | 11/1979 | Gerling | |
| 4,546,226 | A | 10/1985 | Trembley et al. | |
| 4,870,233 | A | 9/1989 | McDonald et al. | |
| 5,072,087 | A * | 12/1991 | Apte et al. | 219/759 |
| 5,106,594 | A | 4/1992 | Held et al. | |
| 5,408,074 | A * | 4/1995 | Warmbier et al. | 219/701 |
| 5,641,423 | A | 6/1997 | Bridges et al. | |
| 5,674,268 | A | 10/1997 | Riazi | |
| 5,834,476 | A | 11/1998 | Pedersen et al. | |
| 5,942,146 | A | 8/1999 | Blaker et al. | |
| 6,080,978 | A | 6/2000 | Blaker et al. | |
| 6,248,985 | B1 | 6/2001 | Tomasello | |
| 6,344,638 | B1 | 2/2002 | Tomasello | |
| 7,161,126 | B2 | 1/2007 | Ripley | |

* cited by examiner

*Primary Examiner* — Brian Casler
*Assistant Examiner* — Joel M Lamprecht
(74) *Attorney, Agent, or Firm* — Michael J. Renner; Luedeka, Neely & Graham, P.C.

(57) ABSTRACT

An apparatus for heat treating manufactured components using microwave energy and microwave susceptor material. Heat treating medium such as eutectic salts may be employed. A fluidized bed introduces process gases which may include carburizing or nitriding gases The process may be operated in a batch mode or continuous process mode. A microwave heating probe may be used to restart a frozen eutectic salt bath.

5 Claims, 10 Drawing Sheets

APPARATUS WITH MODERATING MATERIAL FOR MICROWAVE HEAT TREATMENT OF MANUFACTURED COMPONENTS

CROSS REFERENCE TO RELATED APPLICATIONS

This patent application is a Divisional Application of currently pending and allowed U.S. patent application Ser. No. 11/567,025 filed Dec. 5, 2006 now U.S. Pat. No. 7,358,469, entitled: "APPARATUS FOR MICROWAVE HEAT TREATMENT OF MANUFACTURED COMPONENTS," which is a Divisional Application of U.S. patent application Ser. No. 11/269,236 filed Nov. 8, 2005 now U.S. Pat No. 7,161,126, entitled: "MICROWAVE HEAT TREATING OF MANUFACTURED COMPONENTS," now issued as U.S. Pat. No. 7,161,126, which claims priority from U.S. Provisional Patent Application No. 60/626,715 filed Nov. 10, 2004, entitled: "MICROWAVE HEAT TREATING OF MANUFACTURED COMPONENTS," and is related to U.S. patent application Ser. No. 11/566,988 entitled "METHODS FOR MICROWAVE HEAT TREAMENT OF MANUFACTURED COMPONENTS."

GOVERNMENT RIGHTS

The U.S. Government has rights to this invention pursuant to contract number DE-AC05-00OR22800 between the U.S. Department of Energy and BWXT Y-12, L.L.C.

FIELD

This invention relates to the field of heat treating of manufactured components. More particularly, this invention relates to heat treatments in which the components are in contact with solid particulates liquids, or process gases as part of the heat treatment process.

BACKGROUND

Current systems for chemical process heat treating or thermal heat treating of metal or other manufactured components are typically conducted on a relatively large scale for reasons of economy. For example, eutectic salt baths are commonly used, and they generally are operated continuously. Operating a continuous, high temperature, eutectic salt process is expensive both in the initial capital investment and in operating costs. Energy costs are generally high in these systems, and generally the equipment must be left running even if no parts are being processed because it is difficult to restart a bath that has solidified (frozen). Some oven and furnace methods of heat-treating processes eliminate some of the economic drawbacks of molten salt processing. However, with such systems several of the processing benefits from a molten salt process are forfeited. The benefits foregone include excellent heat transfer of molten salt, the ability to quickly process parts, and the ability to add and remove parts with different heat treating requirements while allowing other parts to remain in the system longer. What is needed therefore is a heat treatment system that captures all or at least many of the benefits of a salt bath heat treatment system without as much expense.

SUMMARY

The present invention provides a heat treating system for a component. The system includes a microwave applicator chamber and a processing container. The processing container includes a casket placed within the microwave applicator chamber where the casket is thermally insulating and substantially transparent to microwave energy. The processing container also includes a corrosion-resistant heat treating vessel having an exterior surface. The corrosion-resistant heat treating vessel is configured to establish a space between a substantial portion of exterior surface of the corrosion-resistant heat treating vessel and the casket when the corrosion-resistant heat treating vessel is placed within the casket. The corrosion-resistant heat treating vessel is farther configured to hold the component and a heat treating medium placed within the heat treating vessel. The processing container also has microwave susceptor material that is positioned between the casket and the corrosion-resistant heat treating vessel, so that a substantial portion of the exterior surface of the heat treating vessel is in contact with the microwave susceptor material. The heat treating system also includes heat treating medium that is placed within the corrosion-resistant heat treating vessel. In some instances the microwave susceptor material is a layer of material bonded to the corrosion-resistant heat treating vessel. The microwave applicator chamber may have a protective entry door and a protective exit door. A conveyor apparatus may be provided for moving the container through the microwave applicator chamber.

Also, a heat treating system for components is provided where the system includes a microwave applicator chamber having a protective entry door and a protective exit door, and a plurality of processing containers. Each processing container includes a casket that is thermally insulating and substantially transparent to microwave energy. Each processing container also includes a corrosion-resistant heat treating vessel having an exterior surface, with the corrosion-resistant heat treating vessel being configured to establish a space between a substantial portion of exterior surface of the corrosion-resistant heat treating vessel and the casket when the corrosion-resistant heat treating vessel is placed within the casket. The corrosion-resistant heat treating vessel is further configured to hold the component and a heat treating medium placed within the corrosion-resistant heat treating vessel. Microwave susceptor material is positioned between the casket and the heat treating vessel, so that a substantial portion of the exterior surface of the heat treating vessel is in contact with the microwave susceptor material. A conveyor apparatus is provided for moving components into the microwave applicator chamber through the protective entry door and then out the protective exit door.

A method of heat treating components is established. The method includes melting a heat treating medium using microwaves, placing the components in the molten heat treating medium, heating the molten heat treating medium sufficiently to maintain the molten state, and then removing the components from the molten heat treating medium. The step of heating the molten heat treating medium sufficiently to maintain the molten state may involve heating the molten heat treating medium using microwave energy. The method may also include a step of discontinuing the heating of the molten heat treating medium after removing the components from the molten heat treating medium.

A heat treating system is provided where the system includes an insulating vessel placed within a microwave applicator chamber. The insulating vessel is thermally insulating and substantially transparent to microwave energy, and the insulating vessel holds at least one component for heat treating, each component having an exterior surface. The insulating vessel further holds moderating material selected from the group consisting of (a) microwave susceptor material, and (b) a mixture of microwave susceptor material and microwave transparent material. The moderating material is positioned inside the insulating vessel so that a substantial portion of the exterior surface of the components is in contact with the moderating material. Sometimes the microwave susceptor material includes glassy carbon particles. Sometimes the system further includes a conveyor apparatus.

A heat treating system for components is provided where the system includes a microwave applicator chamber, an insulating vessel placed within the microwave applicator chamber, a gas supply for feeding process gas to the insulating vessel through a screen, and granular microwave susceptor material positioned to receive the process gas after it flows through the screen. Space is provided for components in the granular microwave susceptor material, the space being configured so that a substantial portion of the exterior surface of each component is in contact with the granular microwave susceptor material. Sometimes the process gas includes a surface treatment gas. Sometimes the surface treatment gas includes a carburizing gas and sometimes the surface treatment gas includes a nitriding gas.

A method of heat treating components is provided, where the method includes the steps of loading a fluidized bed insulating vessel with components and granular microwave susceptor material such that a substantial portion of the exterior surface of each component is in contact with the granular microwave susceptor material, exposing the loaded fluidized bed insulating vessel to microwave radiation, and pumping process gas into the loaded fluidized bed insulating vessel. In some instances the method further includes pumping surface treatment gas into the fluidized bed insulating vessel. Sometimes the method includes pumping carburizing gas into the loaded fluidized bed insulating vessel and sometimes the method includes pumping nitriding gas into the loaded fluidized bed insulating vessel.

A further alternative embodiment provides a heat treating system for a component. The system includes a heat treatment block composed at least in part of a material that is a susceptor of microwaves. The heat treatment block is configured to support the component. There is a conveyor apparatus configured to support the heat treatment block and the component thereon. A microwave applicator chamber having a protective entry door and a protective exit door is provided. The microwave applicator chamber and the protective entry door and the protective exit door are configured for passage therethrough by the conveyor apparatus that is supporting the heat treatment block that is supporting the component.

BRIEF DESCRIPTION OF THE DRAWINGS

Further advantages are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
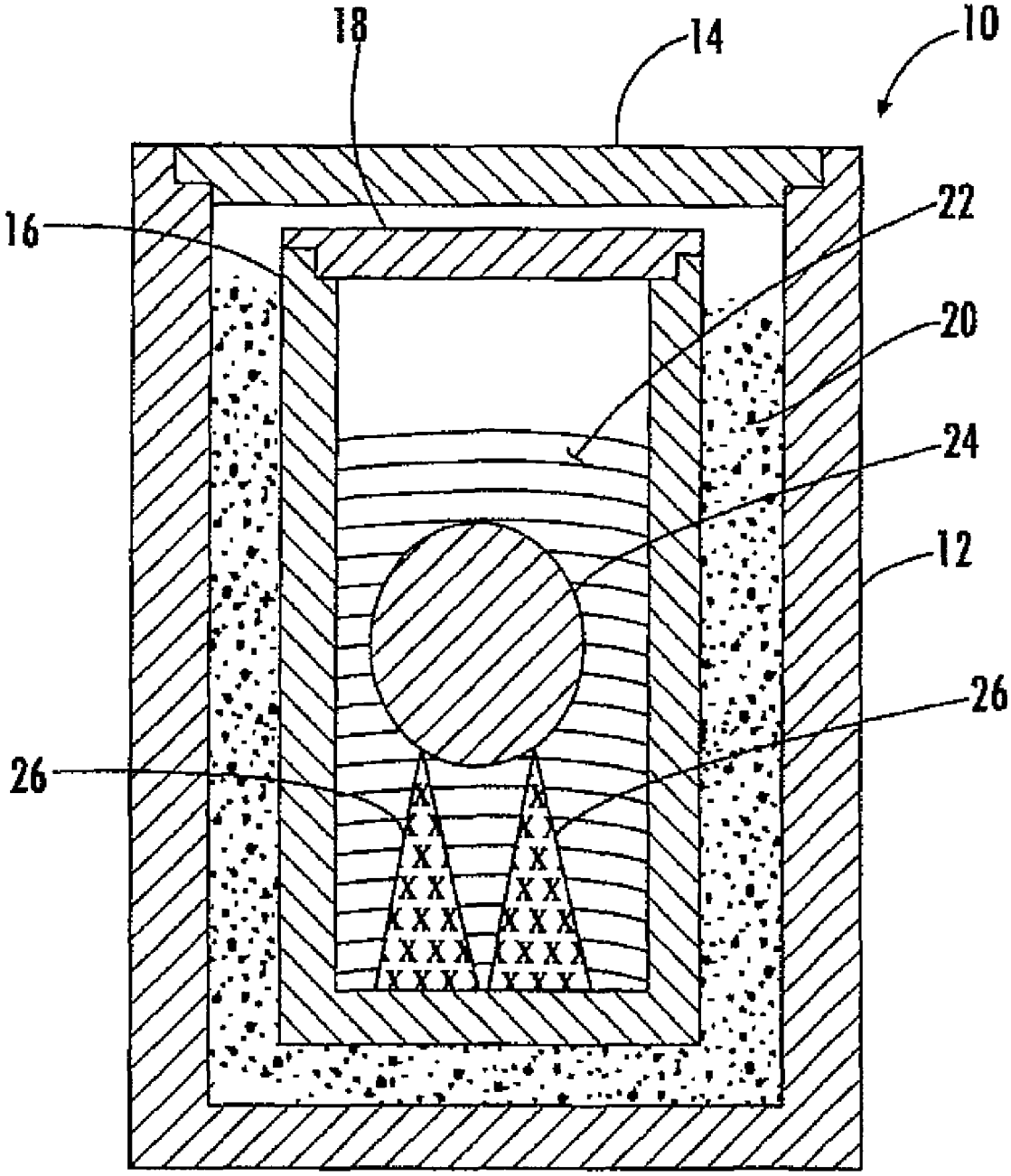
FIG. 1 is a cutaway schematic illustration of a component heat treatment assembly.

Further defined herein are a number of embodiments of a system for heat treating metal component parts. Various embodiments include batch processes and continuous processes. A wide variety of ferrous and non-ferrous metals may be processed, and in some embodiments the apparatus (and associated process) is directly applicable to many currently-used eutectic salt heat treating methods. In addition, defined herein is a system and method for using a solid or powdered microwave absorbing (suscepting) material to perform an all-solid method of heat treating. Such solid material methods generally have an advantage when contamination of the metal is a concern because the heat treating material never melts and the atmosphere may be controlled during the heat treating process. In some embodiments the system is adapted for fluidized bed heat treating and surface modification techniques such as carburizing, decarburizing, nitriding, etc. Further alternate embodiments use the methods and systems described herein for materials other than metals, such as for composite materials.

Many of the embodiments involve the use of a microwave applicator chamber. A microwave applicator chamber is the enclosure where microwaves meet and heat the material to be processed In a common household microwave oven the microwave applicator chamber is the compartment where the food to be heated is placed. In technical terms, the microwave applicator chamber is a cavity that is preferably dimensioned to be a multimode resonator. Microwave energy is fed from a microwave generator such as a magnetron, though a waveguide into the microwave applicator chamber. In preferred embodiments, the microwave generator is a standard industrial microwave device. A plurality of waveguides may be used, and generally they are also industry-standard. The applicator chamber is also standard, although continuous heat treatment processing requires an applicator chamber with a protective entry door and a protective exit door. The protective doors permit metal component parts to continuously enter and leave the applicator chamber, while substantially preventing the escape of microwave radiation from the applicator chamber. Such prevention may be accomplished by using metal pins or mesh to keep the microwaves reflecting inside the applicator chamber. As long as the smallest opening between pins or in a mesh is less than the wavelength of the microwaves, the microwaves cannot escape. 2.45 GHz microwave energy has a wavelength of about 3 cm. Consequently, the protective door design must not present an opening in the door that is larger than that, and preferably a margin of safety is provided. This can be accomplished, at least in part, by carefully controlling the difference in the size of the opening in the door and the size of the component going through the door. Other features, such as pins or chains may be used to prevent exit of microwaves.

One other aspect of embodiments that should be carefully planned is the setup of the crucible and heat-treating medium in the microwave applicator chamber. An example of a typical setup for batch process embodiments is as follows. The applicator chamber is preferably a sealed metal container with a sealing door or lid that can be opened and closed, and that will provide a microwave seal to prevent the possibility of microwave leakage. The lid or door is generally also interlocked to prevent the ability to inadvertently operate the microwave generator while the lid is opened.

Inside the applicator chamber is a microwave suscepting crucible or container that couples to microwaves at the desired frequency used (for example 2.45 GHz). The crucible/container holds the parts to be heat treated, and in salt bath systems the crucible/container also holds the heat treatment salts. In preferred embodiments the crucible/container has the ability to absorb microwaves and in salt bath systems the crucible/container preferably has the ability to heat up to a sufficient temperature to melt the salt that forms the salt bath. The crucible/container also should be able to resist chemical attack by the molten salt, or else should be provided with a liner that is resistant to chemical attack by the molten salt. The crucible/container is supported within the applicator chamber volume, preferably using a structural insulation material that is transparent to microwaves. The sides and lid of the crucible/container may also be insulated to prevent heat loss. In preferred applications all of the surfaces of the applicator chamber are covered with this insulating material. The applicator chamber should preferably have a mechanism to control the power input and temperature. Also, control of atmosphere and/or the introduction of a purge gas may be designed into the system if desired.

The system is typically operated in the following manner. The heat treating salt bath or furnace is placed in the crucible/container. The heat treating salt is preferably a eutectic heat treating salt having a designed temperature range appropriate for the intended process and material being treated. The crucible/container is placed within the insulation in the microwave applicator. The cold solidified salt bath is heated to the desired temperature, if needed, using the microwave generating system. The parts to be heat treated are then lowered into the molten salt or heat treating medium by use of a basket or fixture, and then the parts are retrieved after heat treating using the same mechanism.

In alternative embodiments, a long container is filled with the molten salt and the container is placed in a chamber that includes a microwave applicator. The parts are fed into the chamber at a loading station by a conveyer. An array of pins or some similar feature is typically used to prevent the escape of microwaves from the chamber. The parts continue through the applicator chamber on a conveyer and then exit through another array of pins or similar feature. Optionally the parts may then pass through a cooling tunnel or into a quench tank. They are then removed from the conveyor and the conveyer returns to the part loading station.

In some alternative embodiments, the eutectic salt is replaced with a granular suspension of a suscepting medium which is mixed with a microwave transparent medium. The suscepting medium may, for example, be glassy carbon or silicon nitride particles, and the transparent medium may be alumina or fused silica particles. The mixture ratio may be varied by experimentation so that the desired temperature and processing parameters are maintained. The part to be heated is placed in this medium, and the medium and the parts are heated with microwave energy until the desired heat treatment is achieved.

Another embodiment operates as a fluidized bed. An inert atmosphere may be used to process chemically sensitive metals, but in some embodiments the fluidized bed is operated with a chemically active gas or gas mixture to allow the parts to be carburized, decarburized, nitrided, carbon-nitrided, etc. The use of a fluidized bed approach is applicable to both heat treating and curing systems. Tight atmosphere control allows for processes like vacuum processing to be done in conjunction with heat treating for the removal of hydrogen or other dissolved gasses. Some embodiments employ this basic setup for use as a vacuum annealing or similar process.

With minor modification this concept may be used to create a portable piece of equipment which may be used to restart a conventional solidified eutectic salt bath. A high power microwave generator and a probe fitted with a waveguide and a cover which is capable of allowing manipulation of the probe while preventing microwaves from leaking out is all that is required to allow an operator to restart a solidified salt bath. The microwaves are sent through the waveguide and directed at the eutectic salt, The power may be adjusted to ensure adequate heating to create a molten pool between the electrodes. Once the molten pool is established the microwaves could be turned off, the power to the salt bath re-established, and the salt bath brought to temperature.

Some of the advantages of microwave heat treating are as follows. Microwave processing provides an ability to use well-known and well-characterized heat treating media (e.g., eutectic salts) more efficiently. The ability to turn off a molten eutectic salt bath, and restart the same as needed is a significant benefit. The ability to operate a microwave heat-treating process as a fluidized bed provides additional benefits. Microwave heat treating systems and methods may be used to alter the surface and mechanical properties of a component part. Microwave heating is applicable to a large variety of metal/alloy and non-metal systems. Microwave processing is relatively inexpensive and provides a wide range of operational flexibility. Microwave systems are generally smaller and more portable than equivalent capacity conventional systems, so the annealing crucible, insulation and heating medium may be removed to a remote location and stored until needed. This allows for this equipment to be used for other processes when these annealing processes are not required. Additional details and benefits of various embodiments are further understood by a review of the Figures.

FIG. 1 depicts a heat treating assembly 10 according to one embodiment. Heat treating assembly 10 includes an insulating casket 12. Insulating casket 12 is preferably constructed using material such as alumina ($Al_2O_3$) that is thermally insulating and is substantially transparent to microwaves. The most preferred embodiments utilize a composition that is approximately 80% $Al_2O_3$ and 20% silicon dioxide ($SiO_2$), having open porosity of approximately 80% and a density of approximately 30 lbs/ft$^3$ (0.48 gm/cm$^3$). An example is insulation "Type SALI" manufactured by ZIRCAR Ceramics, Inc. Insulating casket 12 has a casket lid 14 preferably made of the same material as casket 12. Inside insulating casket 12 and casket lid 14 is a heat treating vessel 16. Preferably heat treating vessel 16 is corrosion resistant to materials in which it is in contact. A magnesium oxide (MgO) crucible is an example of a general-purpose corrosion-resistant heat treating vessel 16. In some embodiments a vessel lid 18 is provided, preferably made of the same material as heat treating vessel 16.

Between insulating casket 12 and heat treating vessel 16 is microwave susceptor material 20. It is generally important that microwave susceptor material 20 be in physical contact with heat treating vessel 16, as illustrated in FIG. 1. The microwave suscepting material may be loose granules, as depicted in FIG. 1, or the microwave suscepting material may be a solid or semi-solid layer bonded to the exterior surface of heat treating vessel 16. The term "exterior surface" refers to the surface of heat treating vessel 16 that is shown to be in contact with microwave susceptor material 20 in FIG. 1. In some embodiments, the microwave suscepting material is a component of the composition of material from which heat treating vessel 16 is fabricated. For example, heat treating vessel 16 may be a ceramic that is made from a mixture of microwave suscepting and non-suscepting materials. However, the inclusion of a microwave suscepting material in the composition of the vessel 16 may degrade the corrosion resistance of heat treating vessel 16. Also, the inclusion of a suscepting material in the composition of the heat treating vessel 16 may introduce contaminants into the processes being conducted inside heat treating vessel 16. Consequently, in preferred embodiments, microwave susceptor material 20 is either incorporated as granular material surrounding heat treating vessel 16, or microwave susceptor material 20 is a layer bonded to the exterior surface of heat treating vessel 16. Glassy carbon particles are a preferred choice for granular material embodiments of microwave susceptor material 20. A paint or resin containing silicon carbide is a good choice for solid layer embodiments of microwave suscepting material.

Note in FIG. 1 that a sufficient quantity and configuration of granular microwave susceptor material 20 is provided such that a substantial portion of the exterior surface of the heat treating vessel 16 is in contact with the microwave susceptor material 20. In some embodiments a liquid microwave susceptor material 20 is used. Suscepting polymer materials are an example of a liquid microwave susceptor material 20. Granular microwave susceptor materials and liquid microwave susceptor materials are described a "fluid microwave susceptor materials" because they can be flowed around components that are being heat treated.

Inside heat treating vessel 16 is heat treating medium 22. In preferred embodiments, heat treating medium 22 is a eutectic salt, such as calcium carbonate ($CaCO_3$), sodium carbonate ($Na_2CO_3$), potassium carbonate ($K_2CO_3$) or lithium carbonate ($Li_2CO_3$). Chloride salts may also be used. Other materials such as oils or water may be used. When salts are used as heat treating medium 22 they are typically solids at room temperature and must be heated to a molten state. This is accomplished using the assembly of FIG. 1 by placing the heat treatment assembly 10 inside a microwave applicator chamber (not shown) and irradiating heat treatment assembly 10 with microwave energy. The microwave energy passes through insulating casket 12 and casket lid 14. That portion of the microwave energy that strikes microwave susceptor material 20 is at least partially absorbed by microwave susceptor material 20, thereby raising the temperature of microwave susceptor material 20. As the temperature of microwave susceptor material 20 rises, heat is transferred to heat treating vessel 16. The temperature of heat treating vessel 16 rises, thereby heating the heat treating medium 22. This process continues until heat treating medium 22 is at operating temperature (e.g., molten temperature for salt baths).

When heat treating medium 22 is at operating temperature, the casket lid 14 (if used) is removed, as is vessel lid 18 (if used). There is sufficient remaining space in heat treating vessel 16 so that one or more components 24 may be loaded into heat treatment medium 22. One or more stand fixtures 26 may be provided to support component 24 in heat treatment medium 22. Component 24 may be a metal part, or a ceramic/metal composite part, or a part composed of any other material for which heat treatment is desired. After component 24 is lowered into heat treatment medium 22, vessel lid 18 (if used) is placed atop heat treating vessel 16 and casket lid 14 (if used) is placed atop insulating casket 12. Additional microwave energy may then be applied to heat treatment assembly 10 to establish and maintain the operating temperature of heat treatment medium 22 for the period of time necessary to accomplish the desired heat treatment. When the heat treating process is completed, the application of microwave energy is discontinued and the process of loading component 24 into heat treatment medium 22 is reversed to retrieve the heat treated component 24. In some embodiments alternate heat sources such as infrared radiant heating or induction heating or electric resistant heating may be combined with or substituted for some of the steps describe herein as using microwave heating.

Figure 2A:
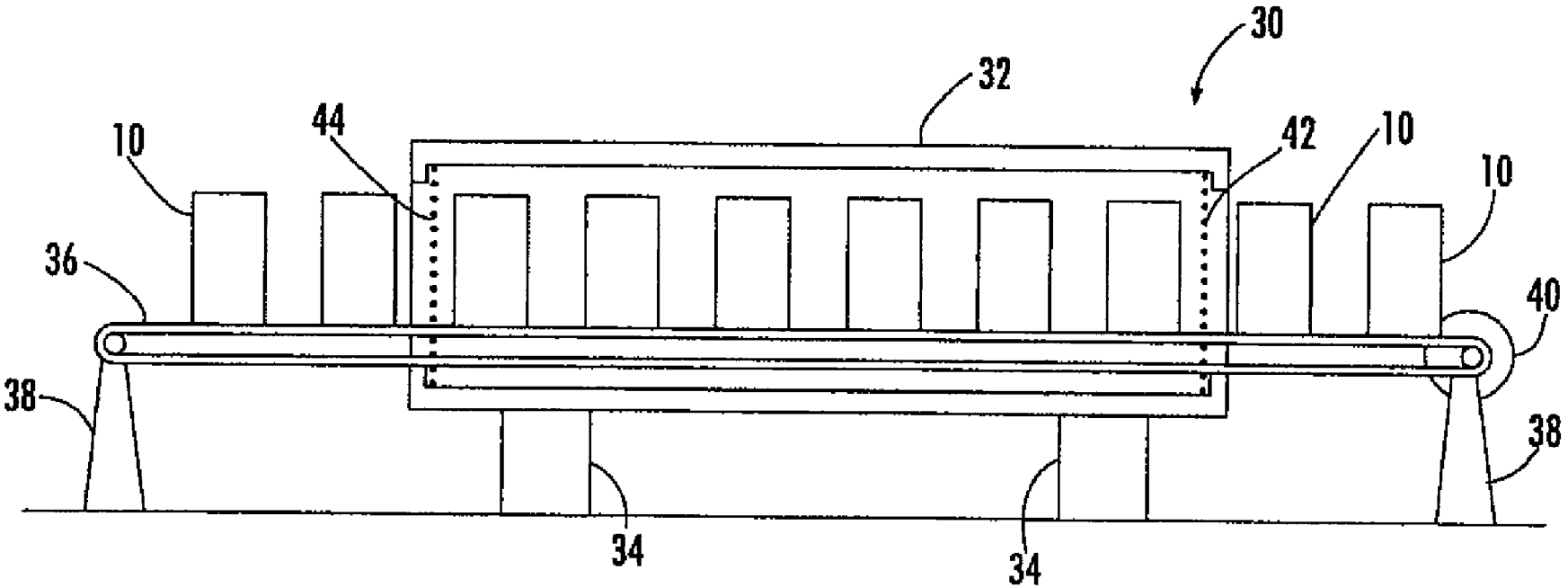
FIG. 2A is a schematic illustration of a component heat treating system.

FIG. 2A illustrates an embodiment providing continuous microwave heat treatment. Casket processing system 30 has a microwave applicator chamber 32 mounted on applicator stand supports 34. A conveyor belt 36 travels through microwave applicator chamber 32. Conveyor belt 36 is an example of a conveyor apparatus, and a conveyor apparatus is a device used to move components through a microwave applicator chamber for heat treatment. Conveyor belt 36 is supported by conveyor stands 38, and is powered by motor 40. Heat treatment assemblies 10 holding components (not shown) are loaded onto conveyor 36 which moves the heat treatment assemblies 10 from right to left in FIG. 2A. Heat treatment assemblies 10 pass through a protective entry door 42 and into microwave applicator chamber 32. Inside microwave applicator chamber 32 the heat treatment assemblies 10 are exposed to microwave energy. After an appropriate residence time in microwave applicator chamber 32, each heat treatment assembly 10 passes through protective exit door 44 and out of microwave applicator chamber 32. Upon exit the components (not shown) are unloaded from heat treatment assemblies 10 and the heat treatment assemblies are recycled for further use. In some embodiments a cooling or quenching process is applied to a component after it is removed from heat treatment assembly 10.

Figure 2B:
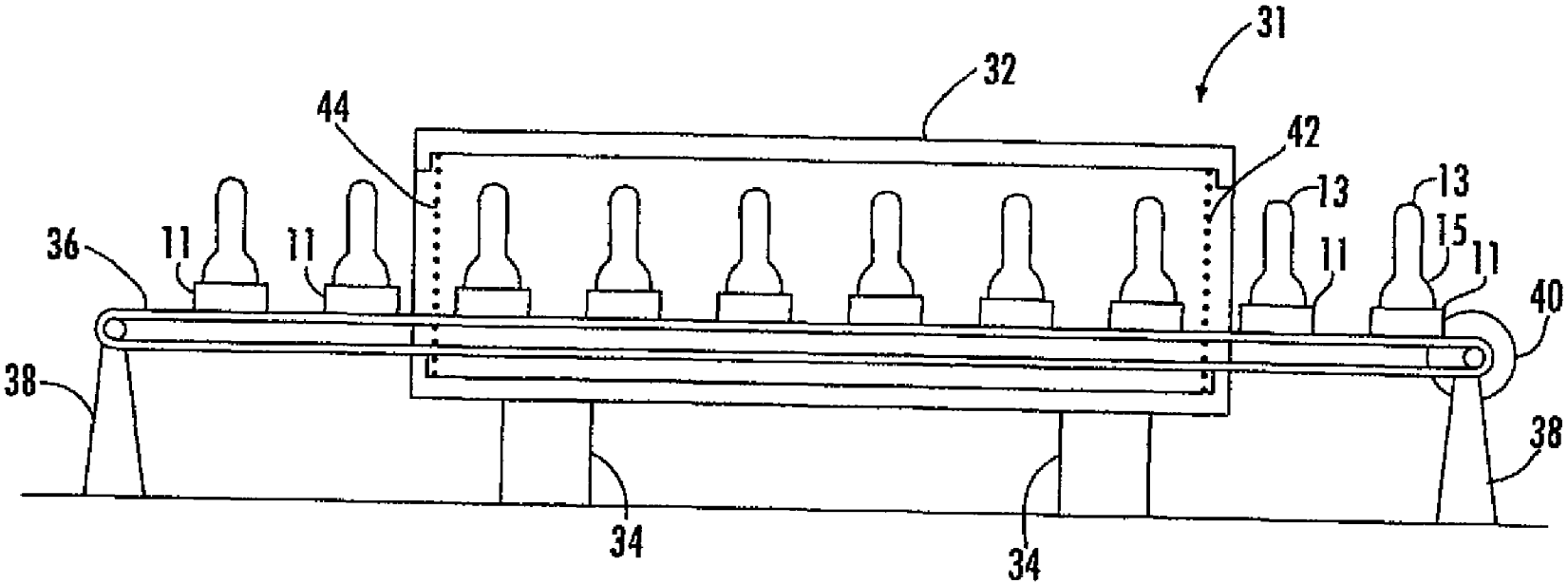
FIG. 2B is a schematic illustration of an alternative embodiment of a component heat treating system.

FIG. 2B illustrates an alternative embodiment providing continuous microwave heat treatment. Casket processing system 31 has a microwave applicator chamber 32 mounted on applicator stand supports 34. Casket processing system 31 is similar to casket processing system 30 in FIG. 2A, in that a conveyor belt 36 travels through microwave applicator chamber 32 and conveyor belt 36 is supported by conveyor stands 38, and is powered by motor 40. Heat treatment blocks 11 are constructed of materials that are susceptors of microwaves. Each heat treatment block 11 supports a component 13. Component 13 is a metal device having a base 15. The heat treatment blocks 11 with components 13 are loaded onto conveyor 36. Conveyor 36 moves the heat treatment blocks 11 and components 13 from right to left in FIG. 2B. Heat treatment blocks 11 and components 13 pass through a protective entry door 42 and then into microwave applicator chamber 32. Inside microwave applicator chamber 32 the heat treatment blocks 11 and components 13 are exposed to microwave energy. Each heat treatment block 11 absorbs microwave energy and heats up. By heat conduction and radiation each beat treatment block 11 heats the base 15 of the component 13 mounted on that heat treatment block 11, thereby heat treating the base 15 (at least) of the component 13. After an appropriate residence time in microwave applicator chamber 32, each heat treatment block 11 and component 13 passes through protective exit door 44 and out of microwave applicator chamber 32. In some embodiments a cooling or quenching process is applied to a component after it exits microwave applicator chamber 32. Upon completion of processing, the components 13 are removed from heat treatment blocks 11, and the heat treatment blocks 11 are recycled for further use.

Figure 3:
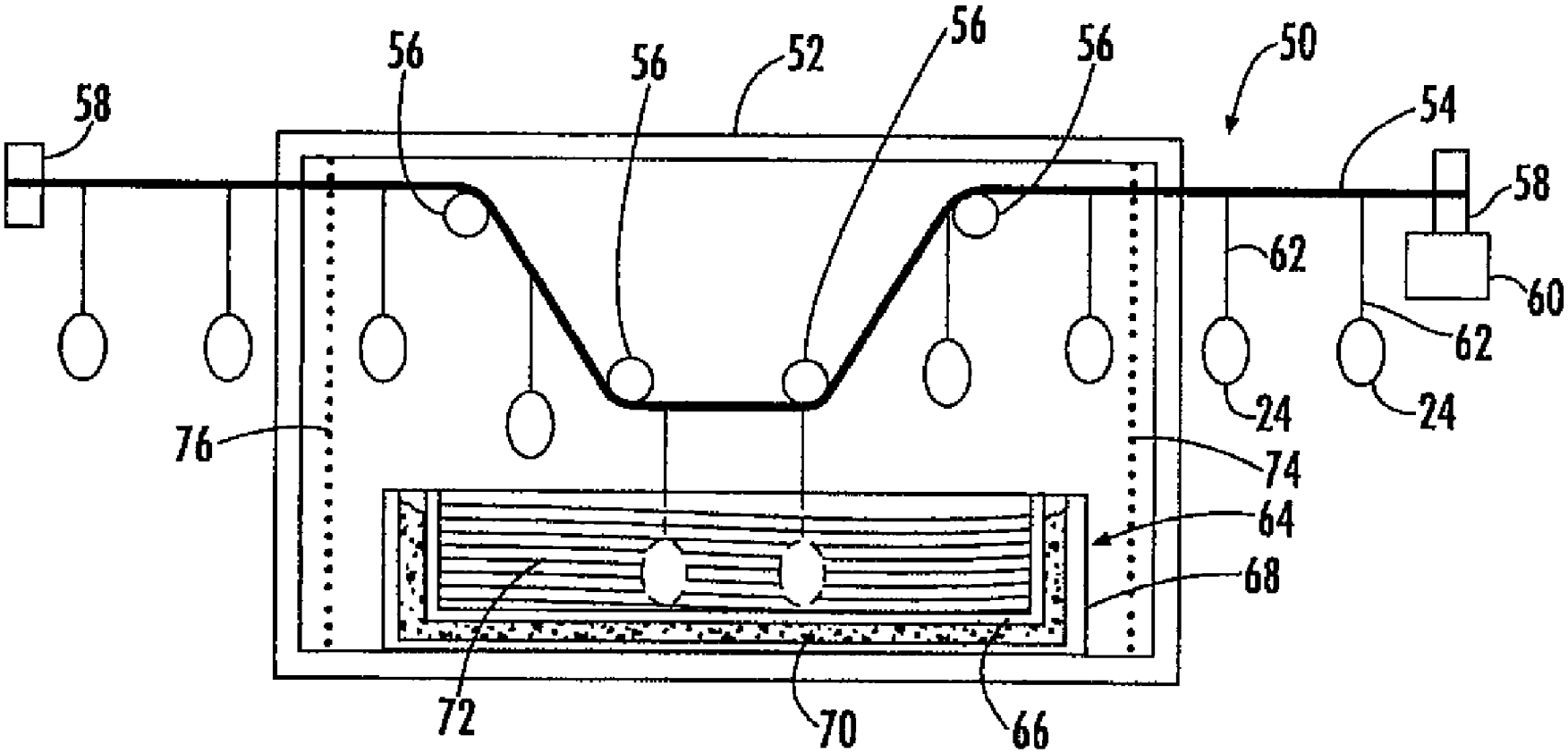
FIG. 3 schematically illustrates a component processing system.

FIG. 3 illustrates an alternate embodiment providing continuous microwave heat treatment. Component processing system 50 includes a microwave applicator chamber 52 and a conveyor cable 54 that passes through microwave applicator chamber 52. Conveyor cable 54 is an example of a conveyor apparatus. Conveyor cable 54 runs on horizontal pulleys 56 and vertical pulleys 58, and is driven by motor 60. Hangers 62 are suspended from conveyor cable 54, and components 24 are loaded onto hangers 62. A heat treatment bath 64 is provided inside microwave applicator chamber 52. Heat treatment bath 64 includes a heat treating vessel 66 that rests in an insulating casket 68. Microwave susceptor material 70 is provided between heat treating vessel 66 and insulating casket 68, in a configuration where a substantial portion of the exterior surface of the heat treating vessel 66 is in contact with the microwave susceptor material 70. The material composition of heat treating vessel 66, insulating casket 68, and microwave susceptor material 70 are comparable to the composition of heat treating vessel 16, insulating casket 18, and microwave susceptor material 20 that were previously described in reference to FIG. 1. Heat treating medium 72 (comparable to heat treating medium 22 previously described) is provided inside heat treating vessel 66. Components 24 are suspended from hangers 62 at the right side of FIG. 3, and conveyor cable 54 transports them into microwave applicator chamber 52 through protective entry door 74. When inside microwave applicator chamber 52, components 24 are lowered into heat treating medium 72 by conveyor cable 54. After an appropriate residency time, components 24 are raised out of heat treating medium 72 by conveyor cable 54 and transported out of microwave applicator chamber 52 through protective exit door 76. Upon exit from microwave applicator chamber 52, components 24 are removed from hangers 62.

Figure 4A:
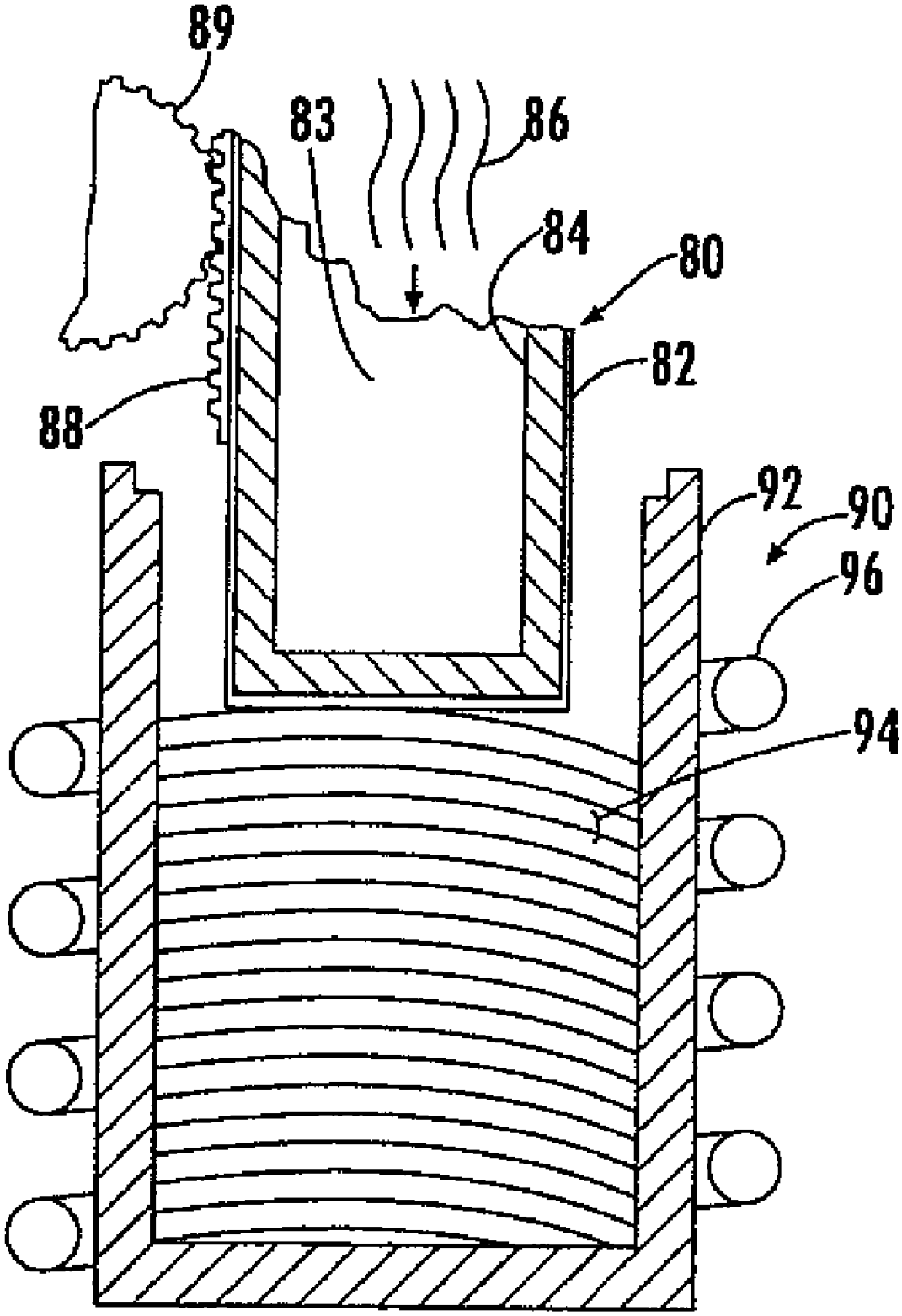
FIG. 4A presents a cross sectional schematic illustration of a microwave heating probe.

FIG. 4A illustrates an embodiment involving a microwave heating probe 80. Microwave heating probe 80 has a protective sheath 82, disposed around microwave susceptor material 84. In the embodiment depicted in FIG. 4A, microwave susceptor material 84 is a solid material bonded to the inside of protective sheath 82. Material substantially comprising silicon carbide is a good selection for microwave susceptor material 84. Microwave susceptor material 84 is depicted in FIG. 4A as having a hollow core 83, but in some embodiments microwave susceptor material 84 may fill the entire internal volume defined by protective sheath 82. Protective sheath 82 is composed of material that is corrosion resistant to the chemicals to which it is exposed, and is typically either metal or ceramic. In some embodiments the microwave susceptor material 84 is corrosion-resistant and a separate protective sheath 82 is not used. Microwaves 86 are directed into microwave heating probe 80 where they heat microwave susceptor material 84, which heats protective sheath 82.

Microwave heating probe 80 is lowered into material processor 90. Material processor 90 has a vessel 92 that contains reactant 94. Reactant 94 may be a conventional heat treatment salt bath, or it may be another heat treatment material. A rack 88 and pinion 89 mechanism may be used as a lowering mechanism. In alternative embodiments the heating probe 80 is configured so that it freely slides up and down and the weight of the heating probe 80 acts as a lowering mechanism. If reactant 94 is solid, as depicted in FIG. 4A, microwave heating probe 80 may be used to melt or merely heat reactant 94 by lowering microwave heating probe 80 proximate to or onto the surface of reactant 94 as illustrated. The heat from microwave heating probe 80 heats reactant 94 to a desired temperature, which often is the melting temperature of reactant 94. If reactant 94 is heated to its melting point microwave heating probe 80 may be further lowered into material process 90 to facilitate additional melting of reactant 94. Once the desired temperature of the reactant 94 is achieved, the direction of microwaves 86 into the microwave heating probe 80 is discontinued, and the microwave heating probe 80 is removed from the vessel 92. If a rack 88 and pinion 89 mechanism is used as the lowering mechanism, the rack 88 and pinion 89 mechanism may be used to remove the microwave heating probe 80 from the vessel 92. If the weight of the microwave heating probe 80 is used as the lowering mechanism, the microwave heating probe may be manually removed from the vessel 92.

Figure 4B:
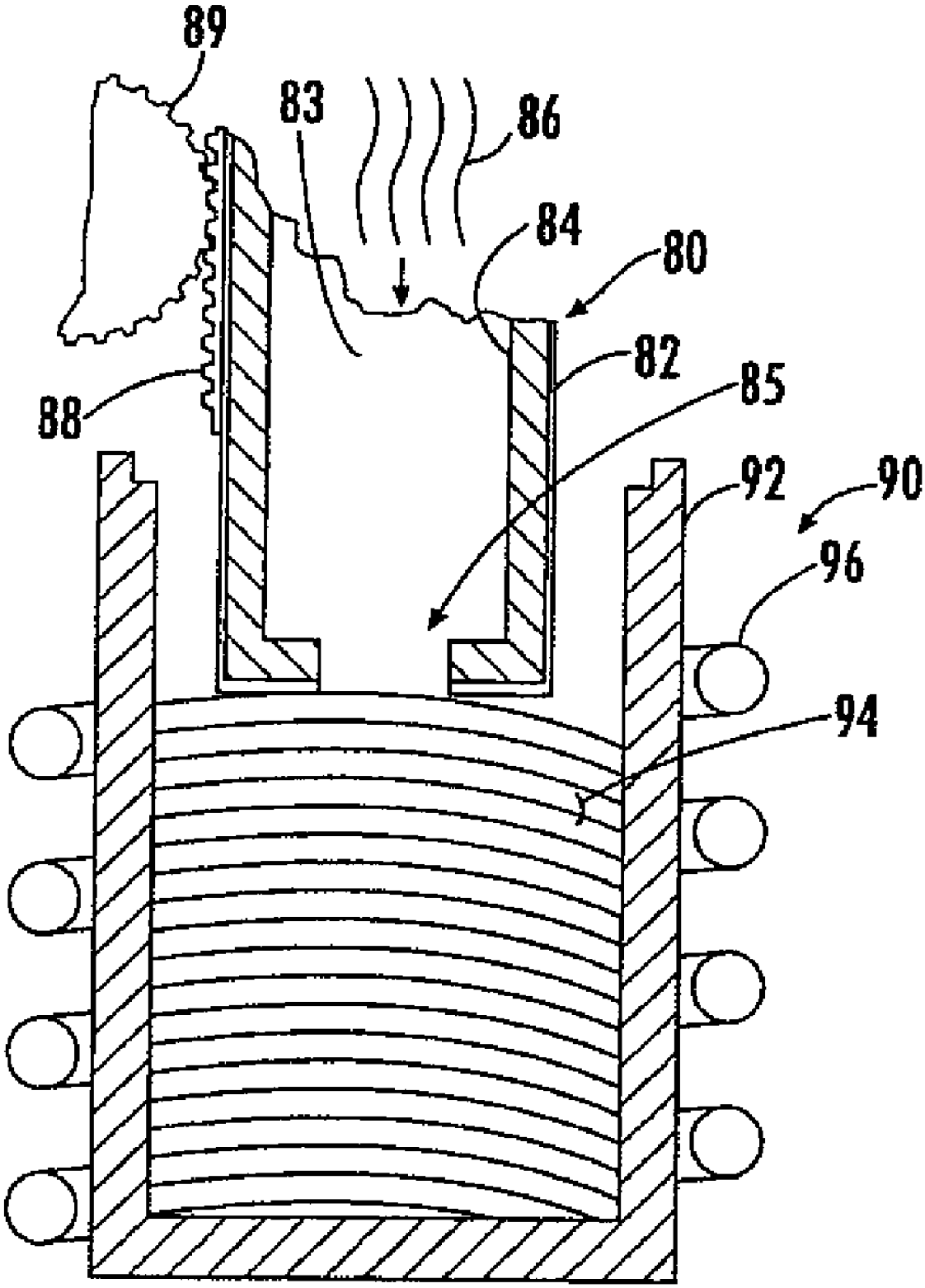
FIG. 4B presents a cross sectional schematic illustration of an alternative heating probe.

As illustrated in FIG. 4B, in some embodiments, particularly where reactant 94 is a susceptor of microwaves, the lower end of heating probe 80 has an opening 85 so that microwave energy is directed to reactant 94 in order for the microwaves 86 to couple with (and heat) the reactant 94. Microwave susceptor material 84 has a hollow core 83 that is at least as large as opening 85 thereby permitting microwaves 86 to flow through the hollow core 83 and the opening 85 to the reactant 94. The heating process may be supplemented by auxiliary heating sources such as the optional electrical resistance coil heater 96 depicted in FIGS. 4A and 4B. In salt bath applications the auxiliary heating is typically applied by electrodes that are inserted into the molten bath. One application of a microwave heating probe 80 is restarting (re-melting) a conventional heat treatment salt bath that has been allowed to solidify. Such baths are difficult to restart conventionally because little current flows between the electrodes when the salt is solidified. After the microwave heating probe 80 has re-melted the heat treatment salt bath (e.g., reactant 94), and the microwave heating probe 80 has been removed from the vessel 92, auxiliary heating may be used to maintain the molten state of the reactant 94.

Figure 5:
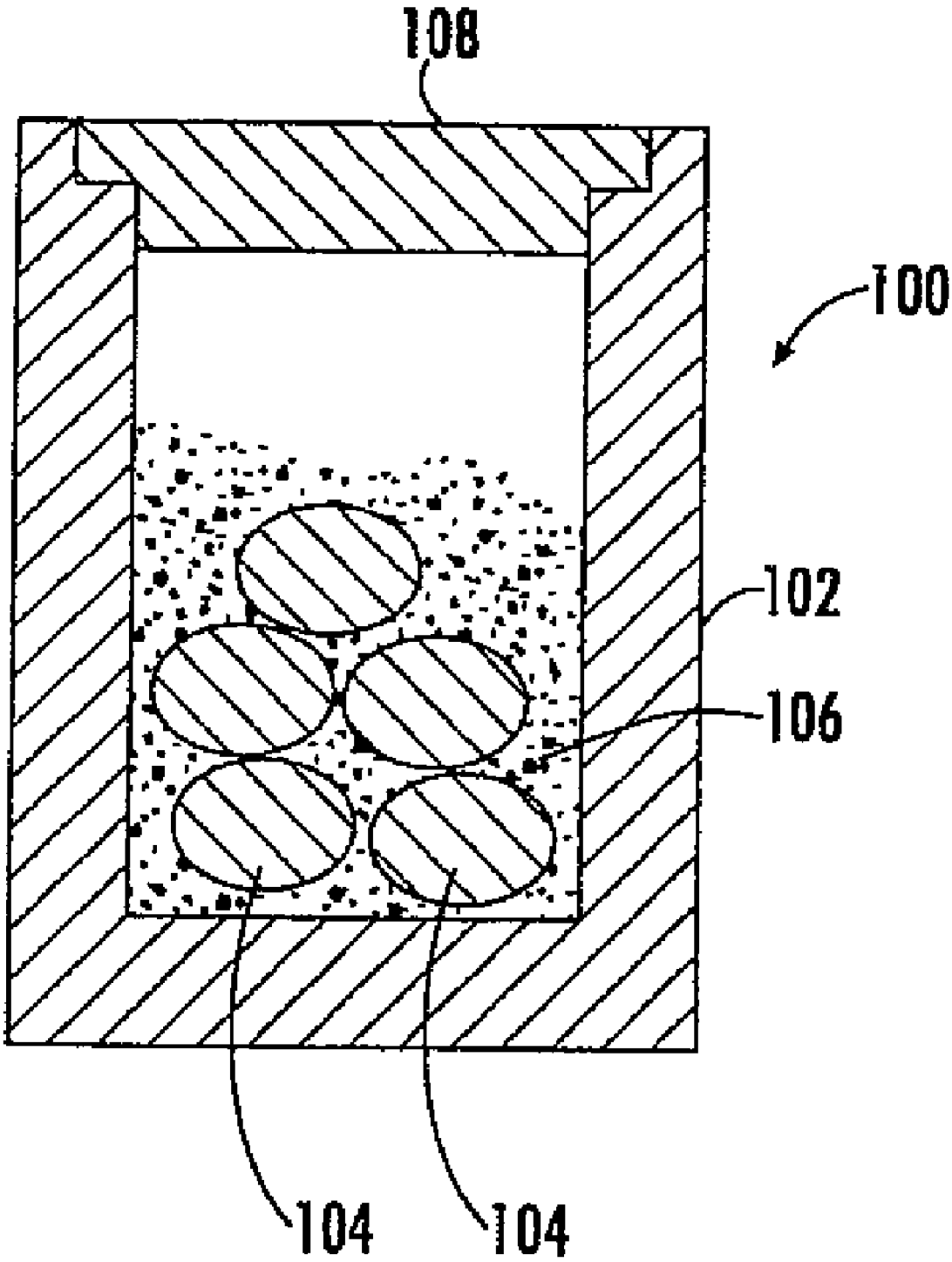
FIG. 5 depicts a component heat treating assembly, illustrated schematically in cross section.

FIG. 5 illustrates an alternate heat treating embodiment. Heat treating assembly 100 uses an insulating vessel 102 configured to have sufficient available space to hold components 104 and moderating material 106. Insulating vessel 102 is generally constructed of materials comparable to those described for insulating casket 12. Insulating vessel 102 is configured so that components 104 are substantially surrounded by moderating material 106. Moderating material 106 is preferably granular suscepting material or liquid suscepting material, or a combination of a suscepting material and a material that is transparent to microwaves. Glassy carbon (which is a susceptor) or a mixture of glassy carbon and alumina (which is transparent to microwaves) are good choices for the moderating material 106. A vessel lid 108, preferably comprising the same materials as insulating vessel 102, may be provided. In some embodiments surface treatment chemicals may be mixed with moderating material 106, but in many embodiments insulating vessel 102 holds only components 104, moderating material 106, and a non-reactive atmosphere (not illustrated) such as air or inert gas that fills the remaining volume of insulating vessel 102. In use, heat treating assembly 100 is placed within a microwave applicator chamber (not illustrated) and exposed to microwave energy. The microwave energy passes through insulating vessel 102 and vessel lid 108 (if used) where a substantial portion of the microwave energy is absorbed by moderating material 106. The temperature of moderating material 106 rises, which provides heat treatment for components 104.

Figure 6:
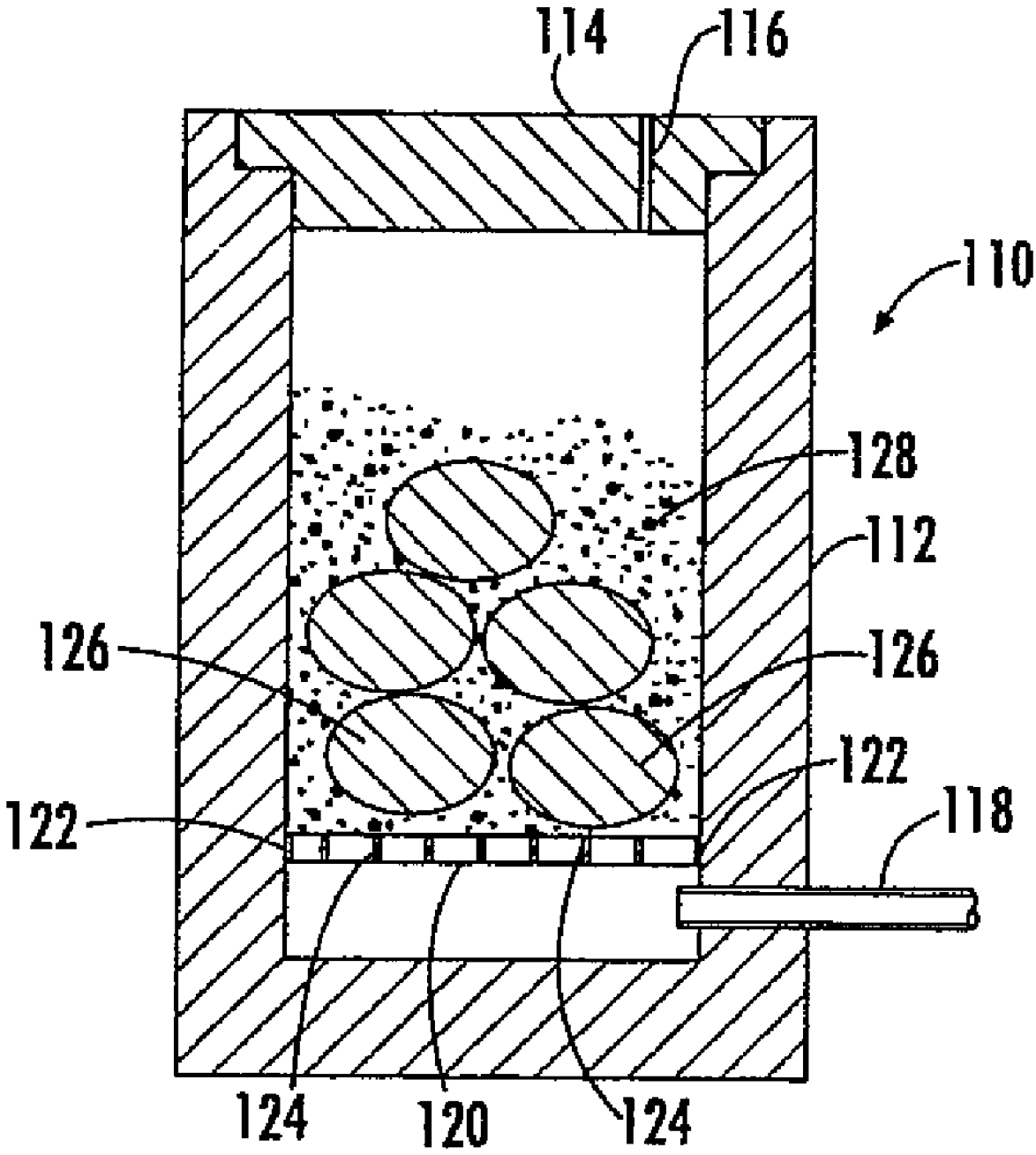
FIG. 6 portrays a schematic cross section of a fluidized bed system according to the invention.
Figure 7:
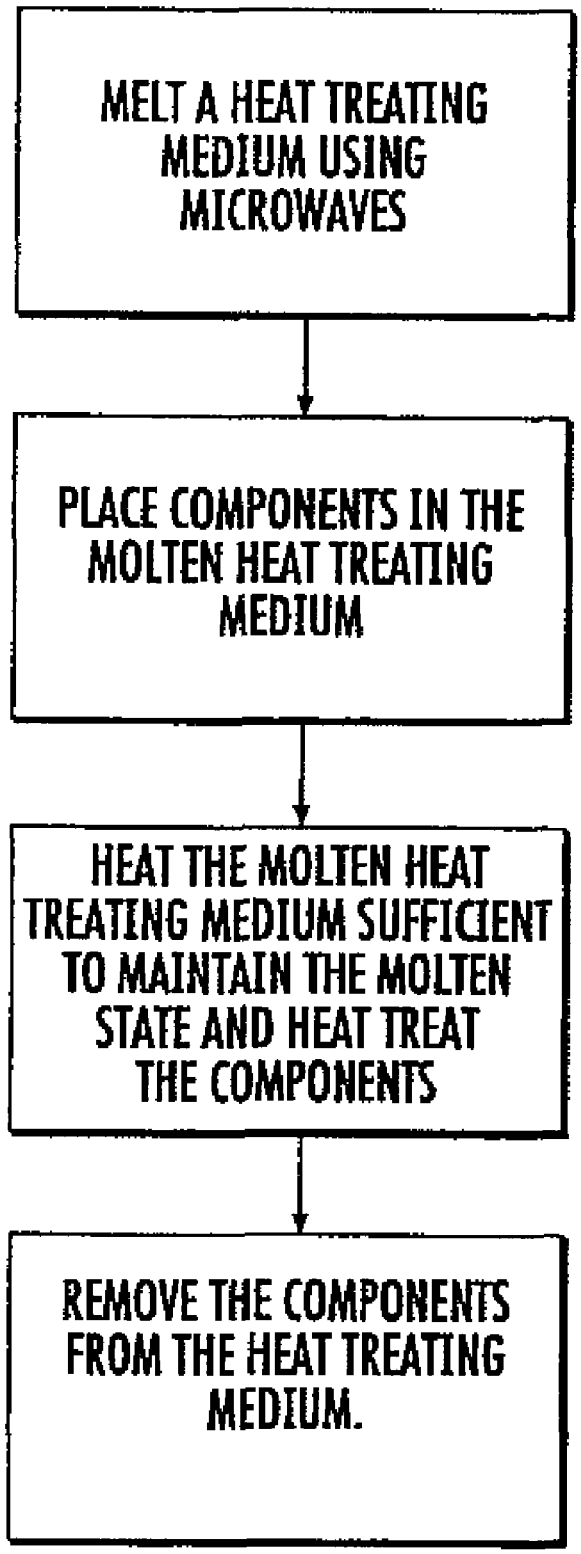
FIG. 7 is a flow chart of a method for heat treating a component.
Figure 8:
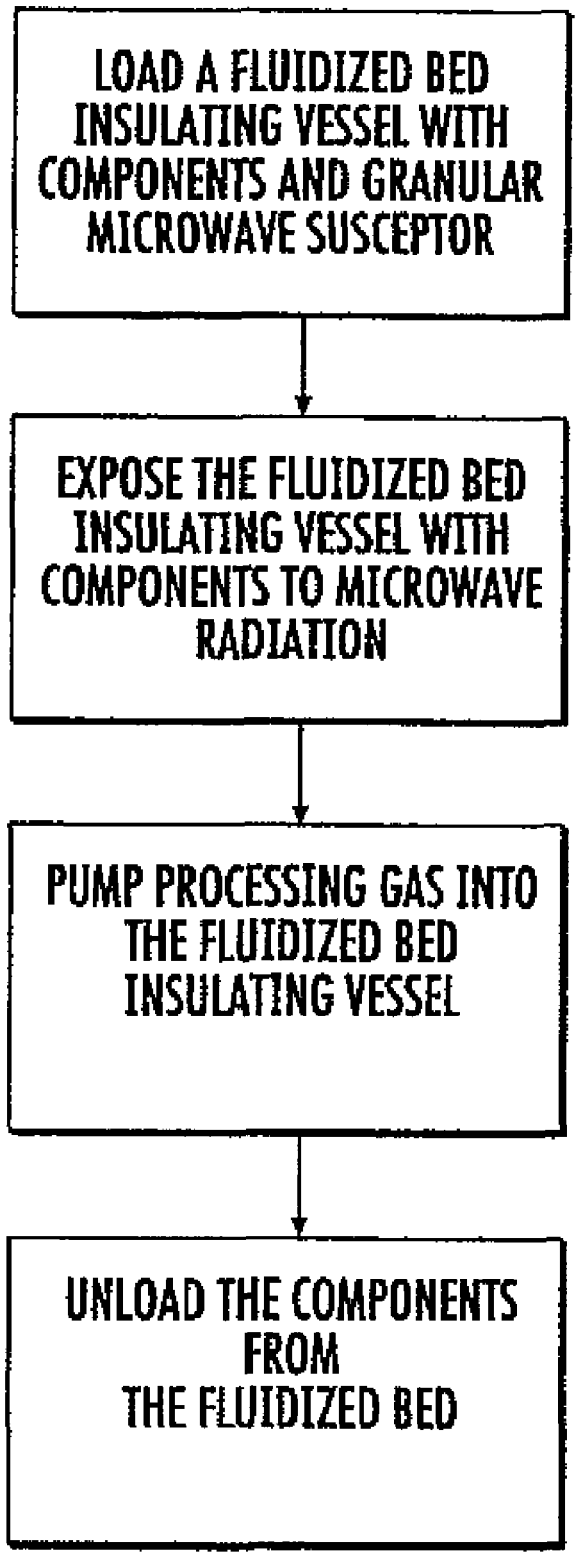
FIG. 8 is flow chart of a different method for heat treating a component.

FIG. 6 illustrates a fluidized bed embodiment. Fluidized bed system 110 includes an insulating vessel 112 with a vessel lid 114. A vent 116 is illustrated in vessel lid 114, but in some embodiments vent 116 may be located in insulating vessel 112. Insulating vessel 112 and vessel lid 114 generally are constructed of materials comparable to those described for insulating casket 12. A gas supply 118 provides a flow of gas into insulating vessel 112 through a screen 120. Screen 120 is assembled to insulating vessel 112 with seals 122, and screen 120 has at least one orifice 124 allowing gas to pass from gas supply 118 through screen 120. An insulating vessel (e.g., 112) having a gas supply (e.g., 118) and a screen (e.g., 120) is called a fluidized bed insulating vessel. One or more components 126 are placed in microwave susceptor material 128 on the side of screen 120 that opposes gas supply 118. Microwave susceptor material 128 includes granular susceptibility material, and in some embodiments surface treatment chemicals (not illustrated) may be mixed with microwave susceptor material 128. In operation, fluidized bed system 110 is placed within a microwave applicator chamber (not shown) and exposed to microwave energy. Microwaves pass through insulating vessel 112 and vessel lid 114 (if used) where microwave energy is absorbed by microwave susceptor material 128. Process gas (not shown) is pumped through gas supply 118. The process gas flows through screen 120, permeates microwave susceptor material 128, and then flows out of fluidized bed system 110 through vent 116. Often the process gas is inert, but in some embodiments the process gas may include chemicals such as acetylene that carbonizes components 126, or ammonia that nitrides components 126. The process gas may also include gases that cause reduction or oxidation of components 126, or gases that cause exothermic or endothermic reactions with components 126.

EXAMPLE

A standard 2.45 GHz multi-mode cavity microwave system was used to heat treat sample parts. The applicator chamber was equipped with vacuum capability as well as capability for introduction of inert, air, nitrogen and other atmospheres. The applicator chamber was also equipped with a mode stirrer to break up any standing waves and create a multi mode, 2.45 GHz, field within the cavity. A pair of 6 kW COBER S6F Industrial Microwave Generators were used to provide the microwaves to the cavity. The waveguides were equipped with dual couplers and a pair of Agilent Power Meters that supplied a signal to an Agilent E44198B EPM Power Meter. A set of quarter wave tuning stubs was placed in each wave-guide to help tune the cavity and reduce the reflected power. In addition, wave matching features were included at the windows where the wave-guide enters the applicator chamber to prevent heating of the windows. One waveguide was directed into the cavity in transverse magnetic (TM) mode, the second was directed into the cavity in transverse electric (TE) mode.

Experiments were performed to compare conventionally-annealed cartridge brass to microwave-annealed cartridge brass. These processes were pure heat treatment cycles that did not employ a salt bath. The microwave processes were conducted using a refractory crucible to contain the cartridges. The crucible was placed in an insulating casket and susceptor particles were packed around the crucible. The conventional annealing was performed in a standard annealing furnace. Coupons made of cartridge brass were used as test specimens. Cartridge brass was selected based on material properties and available data for comparison. Work was performed in three test phases, once using the microwave apparatus and once using the standard apparatus. In Phase I, cartridge brass coupons were heated to 800° F. In Phase II. cartridge brass coupons were heated to 1000° F., and in Phase III, modified cartridge brass gears were heated to 1200° F. In each of these test phases, the microstructure and hardness of the microwave heat-treated samples were compared to conventional heat-treated samples. In all three phases, the microstructure of the microwave samples duplicated the microstructure of the conventional samples. The hardness values of the microwave samples were similar to the conventional samples in all the phases.

The experiment demonstrated homogeneous treatment of the work piece coupons. No negative effects were observed from the use of the microwave process. For example, there were no adverse edge effects or surface effects, and there was no arcing of the metal in the microwave applicator. The microwave process successfully duplicated the results obtained by conventional methods of beat treating a metal. Performing the heat treatment at the higher temperatures resulted in a significant change in microstructure from the as-received samples. The 1200° F. microwave heat treatment produced significant grain growth that was substantially identical to the significant grain growth of conventional heat treatment.

The final (Phase III) test was to compare the heat treatment of a representative industrial shape. A gear that included rounded, sharpened, flat, and typical teeth was used. Various "non-gear" features were cut into the body of the gear to make its geometry more complex. This non-functional design was chosen because it represents a broad range of angles and curvatures in a wide variety of components that are typically heat treated in industry. If there were any negative effects caused by the use of microwaves as a heat source, it would likely have been shown in a component of such design. A set of the above-described modified gears were heated to 1200° F. and held at that temperature for 1 hour in the conventional furnace and a similar set of modified gears underwent the same treatment profile in the microwave apparatus. After the heat treatment, all the gears went through the same evaluation as in the previous tests.

No negative effects were observed by using the microwaves as a heat source. Although the modified gears incorporated several different challenging shapes and curvatures, this did not inhibit the ability of the microwave to successfully heat treat any of the teeth or the base of the gear. The surface finish of the microwave-annealed gear was in the same condition as the conventionally heated gear. The microstructure of the gear heated in the microwave showed homogeneity throughout the entire structure. Arcing is most likely to occur at sharp points, but no arcing was observed during the heat treatment in the microwave.

The foregoing descriptions of preferred embodiments for this invention have been presented for purposes of illustration and description. They are not intended to be exhaustive or to limit the invention to the precise form disclosed. Obvious modifications or variations are possible in light of the above teachings. The embodiments were chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A heat treating system, the system comprising an insulating vessel placed within a microwave applicator chamber, the insulating vessel being thermally insulating and substantially transparent to microwave energy, wherein the insulating vessel holds at least one component for heat treating, each component having an exterior surface, and wherein the insulating vessel further holds moderating material selected from the group consisting of (a) liquid microwave susceptor material, and (b) a mixture of liquid microwave susceptor material and liquid microwave transparent material, where the moderating material is positioned inside the insulating vessel so that a substantial portion of the exterior surface of each component for heat treating is in contact with the moderating material.

2. The heat treating system of claim 1 wherein each component comprises metal.

3. The heat treating system of claim 1 wherein each component is a metal component.

4. The heat treating system of claim 1 wherein each component comprising metal is a metal component.

5. The heat treating system of claim 1 further comprising a conveyor apparatus for moving each component comprising metal through the microwave applicator chamber.

* * * * *